US005984103A

United States Patent [19]

Stirmel et al.

[11] Patent Number: 5,984,103

[45] Date of Patent: Nov. 16, 1999

[54] PROTECTIVE PACKAGING FOR PAGERS AND THE LIKE

[75] Inventors: Timothy M. Stirmel; Richard J. Dyble, both of Janesville, Wis.

[73] Assignee: Panoramic, Inc., Madison, Wis.

[21] Appl. No.: 09/185,341

[22] Filed: Nov. 3, 1998

[51] Int. Cl.[6] ..... B65D 85/00

[52] U.S. Cl. ..... 206/722; 206/37; 206/592

[58] Field of Search ..... 206/576, 320, 206/701, 722, 724, 521, 591, 592, 588, 590, 721, 38, 37

[56] References Cited

U.S. PATENT DOCUMENTS

| | | | |
|---|---|---|---|
| 4,703,161 | 10/1987 | McLean | 206/592 |
| 4,951,817 | 8/1990 | Barletta et al. | 206/37 X |
| 5,593,036 | 1/1997 | Dyble et al. . | |

*Primary Examiner*—Jacob K. Ackun
*Attorney, Agent, or Firm*—Foley & Lardner

[57] ABSTRACT

A protective package for pagers and similar products has a protector on which the pager is mounted. The pager protector has a formed plastic mounting panel having raised lands which are spaced from each other by a center section which forms a cradle for the pager with the raised lands. The pager is mounted on the panel by inserting the spring loaded clip of the pager through a notch in the center section of the panel to slip the center section of the panel between the head of the clip and the pager body until the clip head seats into an indentation in the panel. The notch may have sections of different widths and the indentation may have portions of different depth and periphery so that the insert can be used with pagers of several different standard sizes. The protector with the pager mounted may be enclosed within an outer container that conforms to the general dimensions of the protector to provide a secure, protective packaging structure around the pager and insert. The protector may also have a multi-part structure with the pager mounted on a mounting panel to which a cover panel is joined by an integral hinge. The cover panel is rotated about the hinge to enclose the pager between the cover panel and the mounting panel. A base panel may be joined by a hinge to the cover panel to fold over and be engaged with the bottom of the mounting panel to complete the package.

38 Claims, 10 Drawing Sheets

PROTECTIVE PACKAGING FOR PAGERS AND THE LIKE

FIELD OF THE INVENTION

This invention pertains generally to the field of protective and supportive packaging, and particularly to packaging for electronic products such as pocket pagers.

BACKGROUND OF INVENTION

Significant efforts are specifically made to support and cushion electronic products within the packages in which they are shipped from the manufacturer through the distribution chain to the ultimate customer. Because of the relatively high expense and the vulnerability of such products, some type of protective or cushioning packaging is generally essential. Typical cushioning inserts for electronic products include molded foam plastic inserts in which the electronic product is tightly cradled, custom formed cardboard inserts which tightly hold the product, or loose cushioning materials typically made of foamed plastic.

While foamed plastic inserts and cushioning, or formed cardboard, can provide effective packaging protection for electronic products, such packaging materials add cost and bulk to the packaging. Foamed plastic inserts, in particular, add a significant amount of volume to the overall package in which the electronic product is transported to the customer, and add expense to the overall packaged product by the cost of the production of the inserts and the cost of transportation of the foamed plastic material from the manufacturer to the point at which the electronic products are packaged. Because of the relatively large volume of the foamed plastic inserts compared to their value, transportation costs significantly add to the cost of using such inserts. Alternatively, the foamed plastic inserts may be produced at the point at which they are packaged by the electronic equipment manufacturer, but with the attendant disadvantage that the equipment manufacturer must invest in packaging production equipment which may not be efficiently utilized. In addition, some foamed plastic products are not readily recycled or are not recyclable at all, and when disposed of can contribute to the rapid filling of landfills.

SUMMARY OF THE INVENTION

In accordance with the present invention, a transport package with a cushioning protector is provided which is especially adapted for the shipping of pocket pagers and similar electronic products. The packaging includes a plastic protector which is formed to accept and effectively protect pocket pagers of various standard sizes. The plastic protector which holds the pager in the package can be efficiently and economically manufactured in volume at a central production location and economically transported to the point of use where it is incorporated with the pager in the final packaging container. In addition, the protector can be made of plastics which are readily recycled.

Standard pocket pagers are typically formed with a generally rectangular body having a flat front, back and sides, and a spring loaded clip on the back of the pager which is adapted to fit into a shirt pocket and be clipped in place or to be clipped on a belt or other clothing of the user of the pager. The clip of the pager is spring loaded so as to press a head of the clip tightly against the back of the pager body. Although the dimensions of the various models of pocket pagers are relatively similar, there are differences in the length and width of the clips used by various manufacturers.

The plastic protector of the present invention is formed to accept pocket pagers having different sizes of clips and to use the clips to hold the pager in position on the protector. The pager is thus held in place on the protector by its own clip and may additionally be cushioned by sections of the protector on each side of the pager to prevent lateral movement of the pager and protect it against damage. The protector with pager mounted on it is then secured within a container which fits around the protector and pager during transportation to the ultimate consumer.

A pager protector in accordance with the invention is preferably formed of a plastic mounting panel having a back face and a front face, with surfaces of the back face defining a back plane. A pair of raised lands may be formed in the panel which extend above the back plane and which are spaced from each other by a center section of the panel, generally lying in the back plane, with the center section and raised lands defining a cradle for the pager. A notch in the center section of the panel between the spaced lands is formed to have a width at least as wide as the clip of a pager with which the insert will be used. An indentation is formed in the center section of the panel, spaced longitudinally from the notch, which is raised above the back plane of the panel. The pager is secured to the panel by slipping the center section of the panel between the head of the pager clip and the back of the pager until the head of the clip seats into the indentation in the center section of the panel. The indentation is preferably formed to have a step configuration which will accept and tightly hold the heads of pager clips of various sizes. The notch also may be formed to have a first inwardmost section of a first width and a second outward section of a second, greater width. The typically narrower, shorter clips of some pagers will fit into the first notch section such that the head fits tightly into the indentation, while pagers having wider and longer clips will fit into the second section of the notch and have their heads extend to the indentation where the head will seat snugly into a larger portion of the indentation.

The protector may be formed in a high volume economical production process, such as vacuum forming, from strong plastic material, such as high impact polystyrene, of any desired color (including transparent) or finish. The sheet plastic material of which the protector is made can be selected to be readily recycled. Even if not recycled, the pager protector can be flattened to occupy very little volume if it is disposed of. A particular advantage of the pager protector is that it can be formed such that the raised lands and indentations and other features of the panel are formed in such a way, e.g., with sloped sidewalls, that the protectors can be stacked and nested together for transportation from the point of production of the protectors to the location (e.g., the plant of the electronic equipment manufacturer) where the pagers are packaged for shipment to the consumer. The ability to compactly and economically ship the protectors from the production point to the point of use significantly reduces the transportation costs associated with such protectors as compared with foamed plastic packaging material.

When the pager is mounted on the protector such that the head of the clip is seated within the indentation, the pager will be held against longitudinal movement by the head of the clip. The top and bottom edges of the panel are spaced outwardly from the pager to ensure spacing between the longitudinal ends of the pager and the ends of the container in which the pager and protector are held. The raised lands on either side of the pager hold the pager away from the sidewalls of the container and cushion the pager against impacts from the side. In addition, the raised lands can help distribute any impact forces against the top and bottom container panels to reduce the force on the pager itself, and thus provide additional cushioning for the pager.

The protector may comprise additional plastic panels integrally formed with a mounting panel that holds the pager, and the additional panels can be folded to enclose the mounting panel and the pager held on it. A multi-part protector may include a mounting panel on which a pager is mounted as discussed above, a cover panel joined by a hinge to the mounting panel, and a base panel joined by a hinge to the cover panel. In use, the cover panel may be folded up over the mounting panel and the pager, and the base panel may then be folded under and engaged to the mounting panel to completely enclose the pager with the protector.

Further objects, features and advantages of the invention will be apparent from the following detailed description when taken in conjunction with the accompanying drawings.

DETAILED DESCRIPTION OF THE INVENTION

Figure 1:
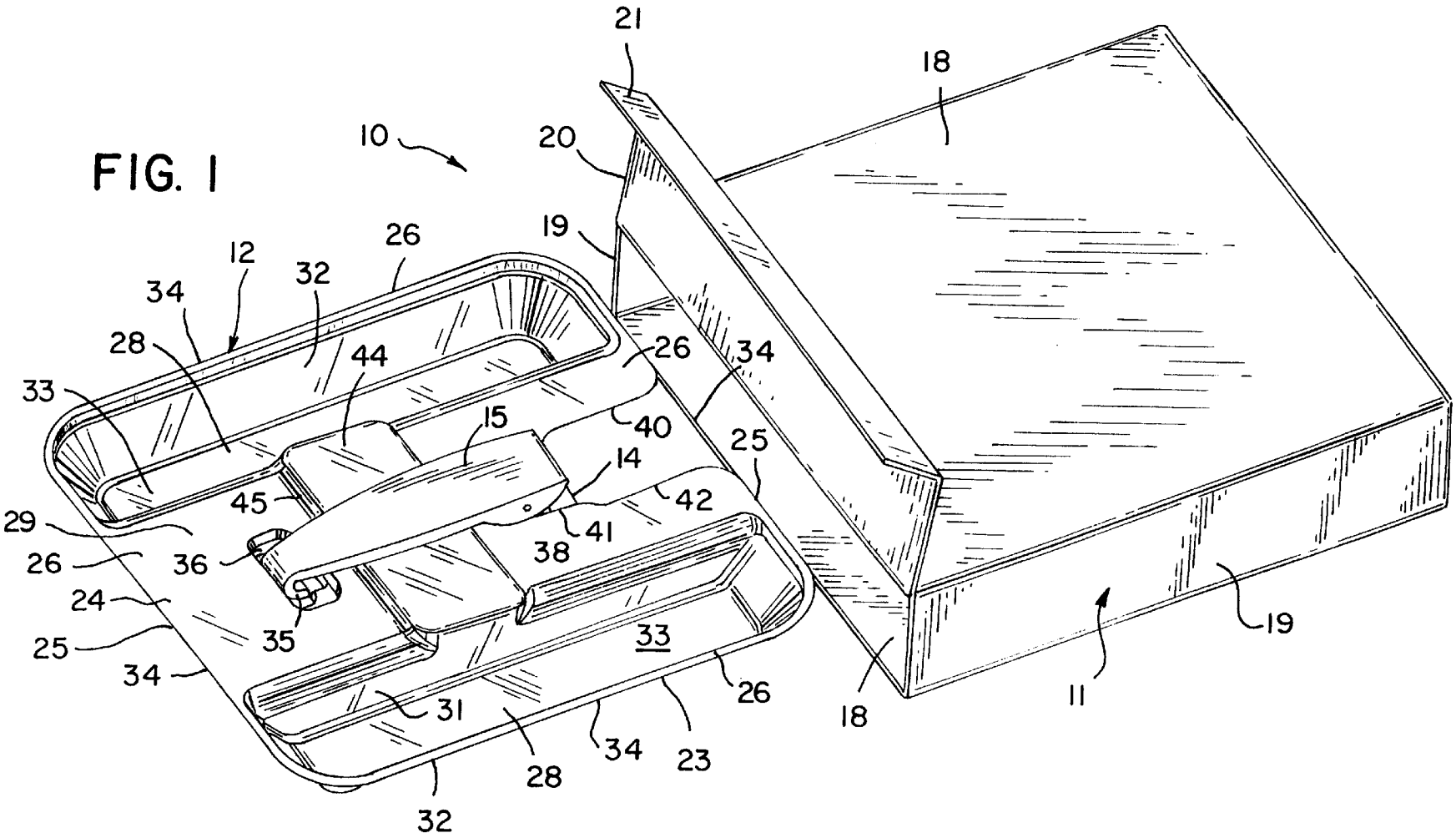
FIG. 1 is a perspective view illustrating the pager protector of the invention with a pager mounted thereon positioned to be inserted into a container box.

With reference to the drawings, packaging for pocket pagers (or similar electronic equipment) in accordance with the invention is shown generally at 10 in FIG. 1. The packaging 10 includes a generally rectangular outer box container 11 and a pager holding protector 12. For purposes of illustration, a pocket pager 14 having a spring loaded clip 15 is shown mounted on the protector 12. The protector 12 with the pager 14 mounted on it is inserted into the interior of the box 11 which is then closed up for shipment to customers. The container 11 may be formed in any conventional manner, for example, as a conventional cardboard or paperboard carton with generally rectangular configuration having top and bottom walls 18, lateral sidewalls 19, and front and back endwalls 20, which may, as illustrated in FIG. 1, include a folding flap 21 by which the end of the box can be closed and sealed in a conventional manner. However, the container 11 may be formed in many other manners and of other materials, as desired, its function being to surround and closely engage at least the bottom and sides of the protector 12 to hold it and the pager 14 snugly. The protector 12 is preferably sized to substantially conform to the dimensions of the interior of the container.

Figure 2:
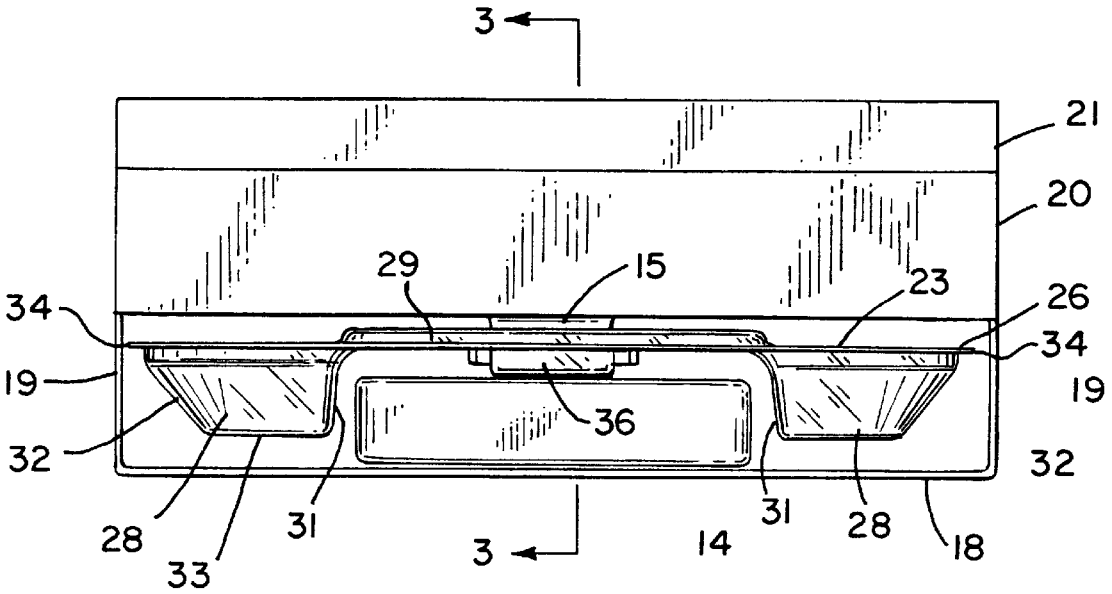
FIG. 2 is an end view of the completed packaging of FIG. 1 with the pager and protector mounted within the container box.
Figure 3:
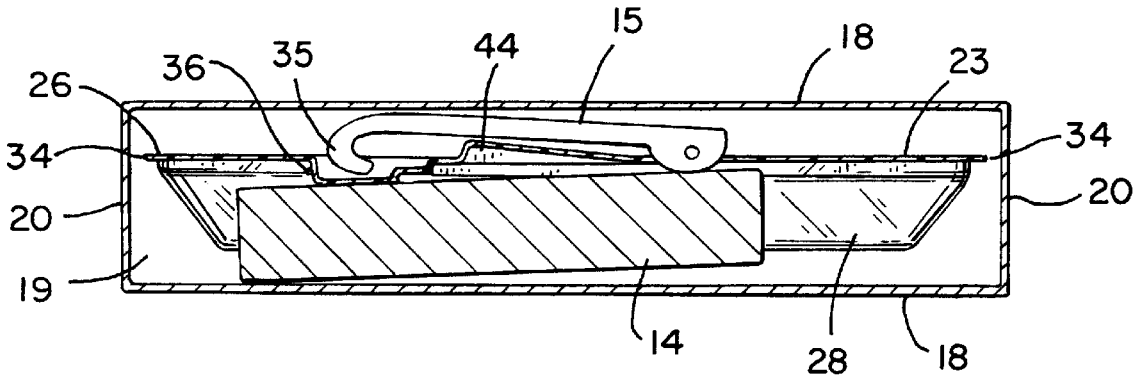
FIG. 3 is a cross-sectional view of the protector and pager mounted within the container box taken generally along the line 3—3 of FIG. 2.

The protector 12 is preferably formed of a plastic mounting panel 23 having a back face 24 and a front face 25 opposite the back face, with surfaces 26 of the back face defining and essentially lying in a back plane. The panel 23 has a pair of integrally formed raised lands 28 which extend above the back plane and which are spaced from each other by a center section 29 of the panel. The center section 29 of the panel generally, although not precisely, lies in the back plane. The raised lands are preferably surrounded by portions of the panel which have surfaces 26 which substantially lie in the back plane of the panel. As best shown in FIG. 2, the center section 29 and the interior side walls 31 of the lands 28 form a cradle for the body of the pager 14. Preferably, the spacing between the sidewalls 31 is somewhat greater than the width of a standard pager so that the pager is relatively closely received between the sidewalls 31 to minimize movement of the pager between the sidewalls during transport. The raised lands 28 also have preferably outwardly sloping outer sidewalls 32 and top walls 33 which are generally flat and are spaced above the surfaces 26 in the back plane. The outer edges 34 of the panel preferably closely engage the inner surfaces of the sidewalls and endwalls of the container to hold the protector 10 in place during shipment. The back face surfaces 26 may also engage against the bottom wall 18 of the outer container 11 to again help hold the protector firmly in place within the outer container.

As best shown in FIG. 1, the head 35 of the spring loaded clip 15 fits into an indentation 36 which is formed in the panel 23 and which is raised above the back plane of the panel in the center section 29 of the panel. The head 35 of the clip 15 engages the walls of the indentation 36 to restrain the clip 15 and the pager 14 to which it is mounted from movement in a longitudinal direction, i.e., a direction parallel to the raised lands 28. A connector 38, by which the clip 15 is connected to the pager 14, fits into a notch 40 formed in the central section of the panel 23. The notch 40 may, as shown, have a first section 41 of a first width, which, for example, is sized so it is slightly larger than the width of the clip 15 illustrated in FIG. 1, and a second section 42, outward from the first section 41, which has a greater width. The greater width section 42 is formed to accept a wider clip than will fit within the section 41 of the notch 40. Generally, pagers having a clip with the wider width, which would be accepted only by the wider section 42 of the notch 40, will also have a longer clip than the clip 15 shown in FIG. 1, so that when the connector of the larger clip is engaged at the bottom of the section 42 where it joins the section 41, the clip will extend sufficiently far so that the head of the clip will fit into the indentation 36. The engagement of the head 35 with the walls of the indentation 36, and the engagement of the connector 38 with the edges of the notch 40, also substantially restrains the pager from movement in a lateral director, i.e., a direction perpendicular to the raised lands 28 and to the longitudinal direction.

The central section 29 of the panel 23 also preferably has a ramp section 44 which inclines upwardly away from the back plane in the direction from the notch 40 to the indentation 36, extending downwardly from the back plane surfaces 26 of the plastic panel 23. The ramp 44 can facilitate the spreading open of the clip 15 from the body of the pager 14 as the pager is mounted onto the panel 23. The ramp 44 also has a back edge wall 45, facing the indentation 36, that will engage the head 35 of the clip 15 if the head is drawn out of the indentation 36, thus again helping to prevent the clip from being accidentally dislodged from the protector 12.

Figure 4:
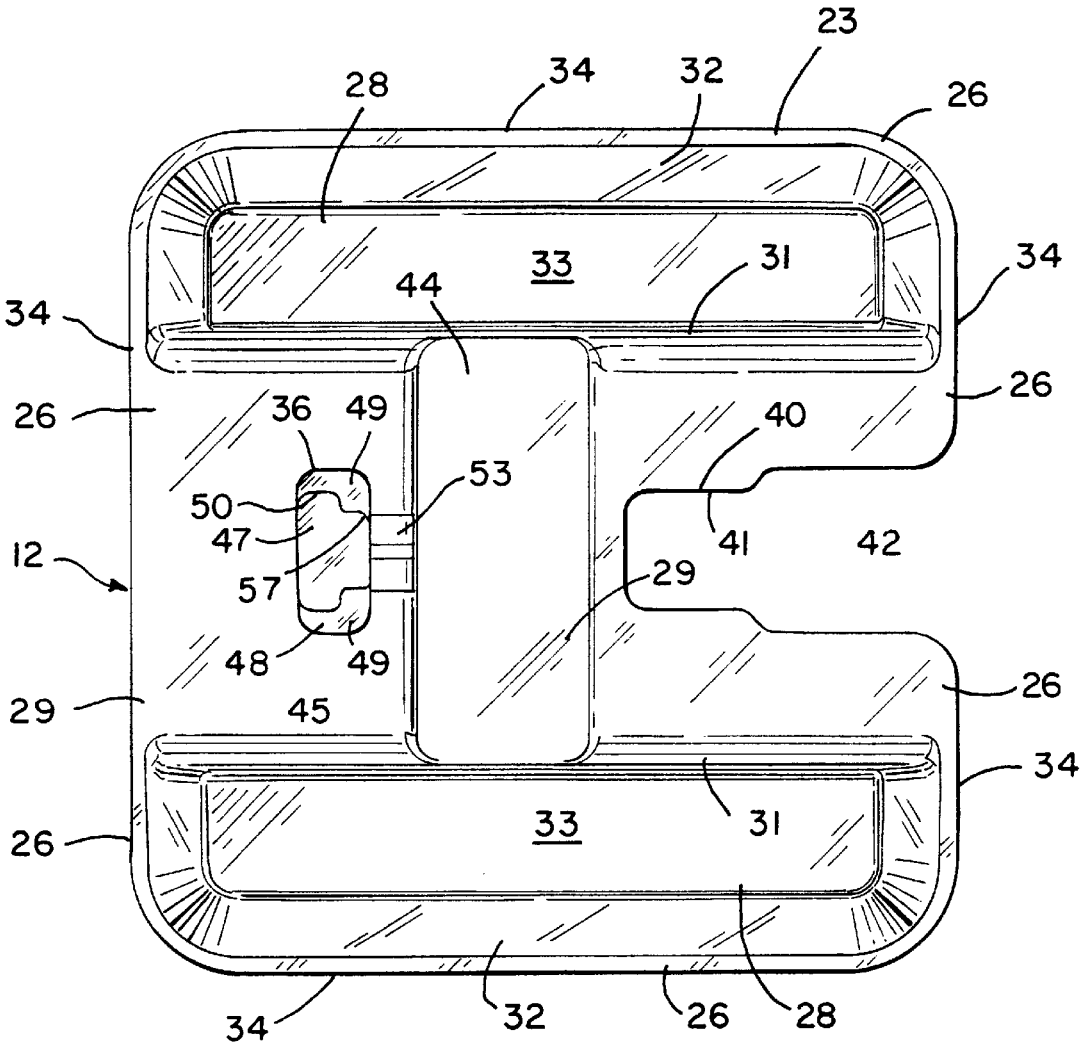
FIG. 4 is a top plan view of the pager protector of the invention.
Figure 5:
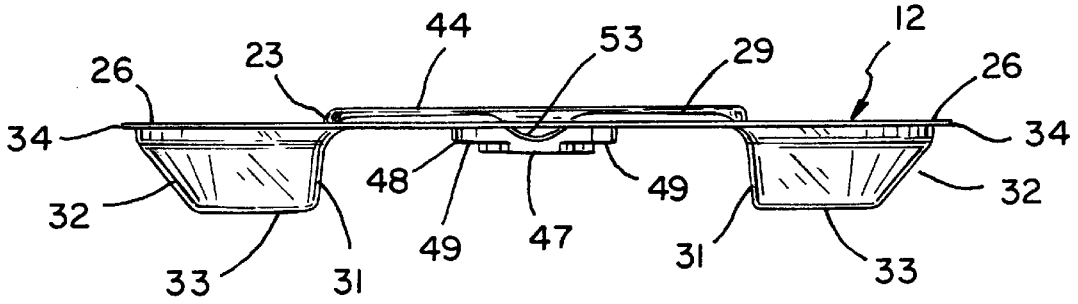
FIG. 5 is a side view of the pager protector taken from the right-hand side of FIG. 4.

As illustrated in FIG. 4, the indentation 36 preferably has a first, inner portion 47 of maximum depth and a first size, and a second outer portion 48 which is larger than the first, inner portion 47 and which has a bottom wall 49 which is at a depth less than the depth of the inner portion 47. The inner portion 47 also preferably has a wider outer section 50 and a narrower inner section 51. A V-shaped indentation 53 is also preferably formed in the panel and extends from the ramp edge wall 45 to the indentation 36. The multiple depths and the peripheral configuration of the indentation 36 adapt the indentation to accept the heads of different sizes of pagers such that a head of any given standard pager will fit snugly within the closest fitting portion of the indentation. The V-shaped groove 53 also facilitates insertion of the clip head into the indentation and may be adapted to most closely receive clips having a similar form.

The protector 12 of the invention can be readily formed from rigid and semi-rigid plastic materials, such as high impact polystyrene, by conventional mass production produces, e.g., by vacuum forming of sheet plastic and subsequent die cutting to cut out the panels to size and to cut the notch 40. The protectors of the invention may be formed of readily recyclable plastic materials such as sheet polystyrene. In addition, even if the protectors are simply disposed of after use, generally can be formed to be sufficiently thin so that it can be crushed or compressed during disposal, whereby the volume of disposed waste represented by the discarded pager protectors is significantly less than that of foamed plastic protective material.

The various upright sidewalls 31 and 32 of the raised lands 28, and the sides of the raised ramp 44 and the indentation 36, are preferably sufficiently flexible and, (particularly for the outer sidewalls 32 of the raised lands) are preferably sloped inwardly, such that a large number of the protectors 12 can be stacked together in nesting relationship. When the formed protectors 12 are stacked in a compact package together in this manner, the shipping costs from the point of manufacture of the protectors to the point at which the protectors are packaged into containers with the pagers to be sent to the customer, is minimized, thereby reducing the overall cost of the packaging for the pagers.

During shipment, the raised land areas 28, formed of relatively stiff but flexible plastic material, may act as shock absorbers to cushion the pager held in the cradle between these raised land areas against lateral impacts. A primary feature of the raised lands 28 is the structural rigidity they contribute to the mounting panel 23, particularly where the panel is formed from thin plastic sheet material. The engagement of the head 35 of the clip in the indentation 36 holds the pager in a position spaced away from the peripheral edges 34 of the protector so that the pager is shielded from impacts at the ends of the container, while the tight engagement of the clip head 35 to the indentation 36 restrains movement of the pager within the container without requiring filling material around the pager.

The pager protector of the present invention may be incorporated in other packaging structures while utilizing the basic protector mounting panel 23 as discussed above. An example of a further embodiment of the protector which has a multi-part construction is shown in perspective view generally at 60 in FIG. 6 in its fully opened form. The multi-part protector 60 includes a first mounting panel 23' which is formed similarly to the panel 23, as discussed above, a second cover panel 61 which is joined by hinge 62 to the mounting panel 23', and a third base panel 64 which is joined by hinge 65 to the cover panel 61. The panels 23', 61 and 64 are preferably integrally formed of a single sheet of plastic by vacuum-forming or similar plastic-forming operations, with the hinges 62 and 65 being integrally formed with the panels of the initial sheet of plastic in a form which allows the panels 23', 61 and 64 to rotate about these hinges.

The respective parts of the mounting panel 23' by which the pager is mounted and secured to the panel, including the notch 40, the indentation 36, the raised lands 28, the surfaces 26 which substantially lie in a back plane of the panel, the center section between the interior sidewalls of the lands 28 which form a cradle for the body of the pager, the ramp 44, the back edge wall 45 of the ramp, and the V-shaped indentation 53, are preferably formed and function as described above with respect to the pager protector 12. The mounting panel 23' of the protector 60 may be formed as shown to have a peripheral flat flange 70 which defines the outer periphery of the panel 23', with an upraised platform or plateau 71 extending from the flange, at the top of which are the back plane surfaces 26 and from which extend the raised lands 28. The pager 14 (not shown) is mounted to the mounting panel 23' with the head of the pager engaged into the indentation 36 in the same manner as described above. The second or cover panel 61 has a flap peripheral flange 73 and a dome 74 which extends downwardly from the peripheral flange 73 with sloping sidewalls 75 and a top wall 76. The third or base panel 64 has a peripheral flange 78, a raised ridge 79 which extends around the periphery of the panel inwardly from the edge of the flange 78, and a central planar section 80.

Figure 9:
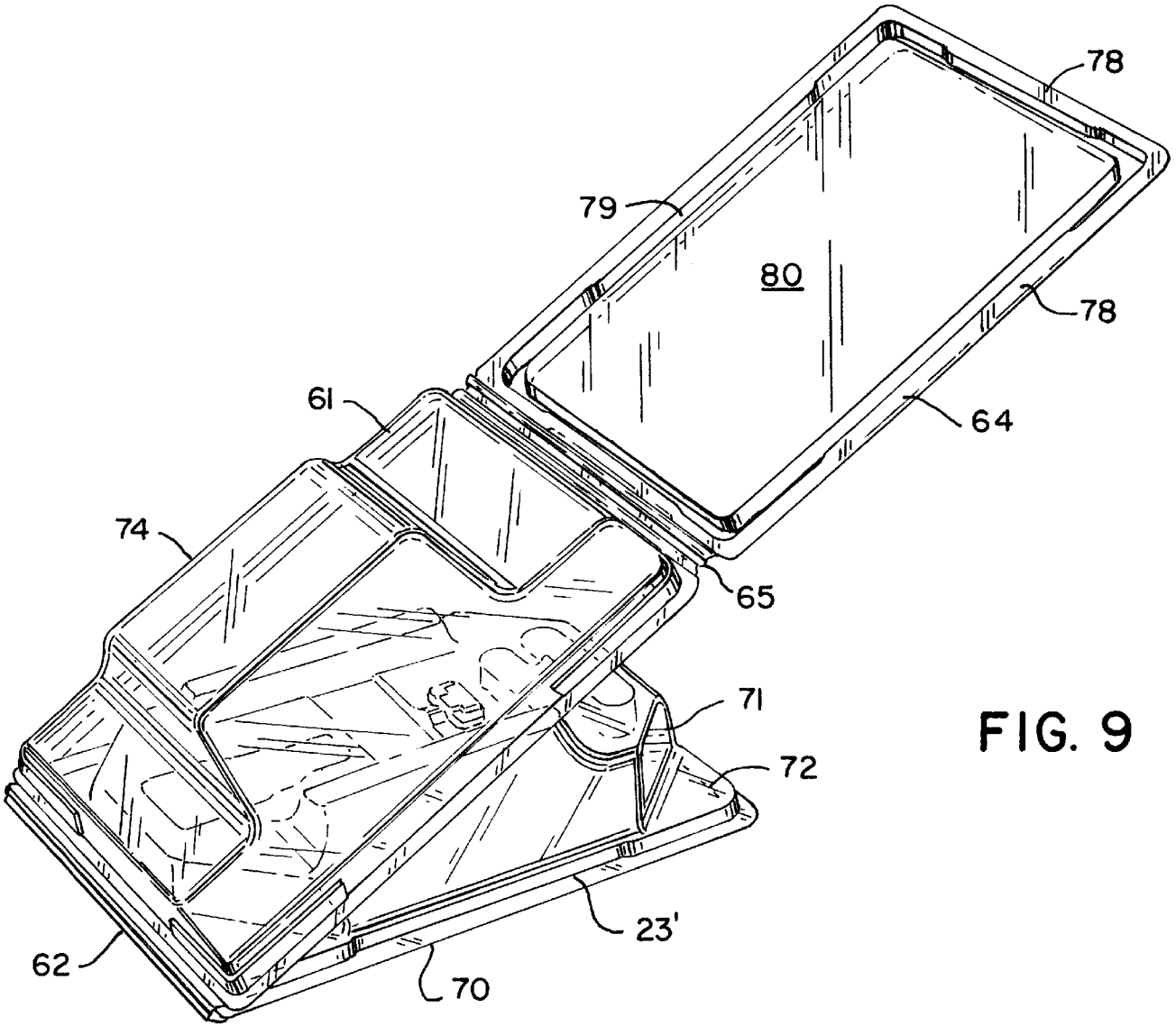
FIG. 9 is a perspective view of the multi-part protector of FIG. 6 showing the parts of the protector in a partially folded position.
Figure 10:
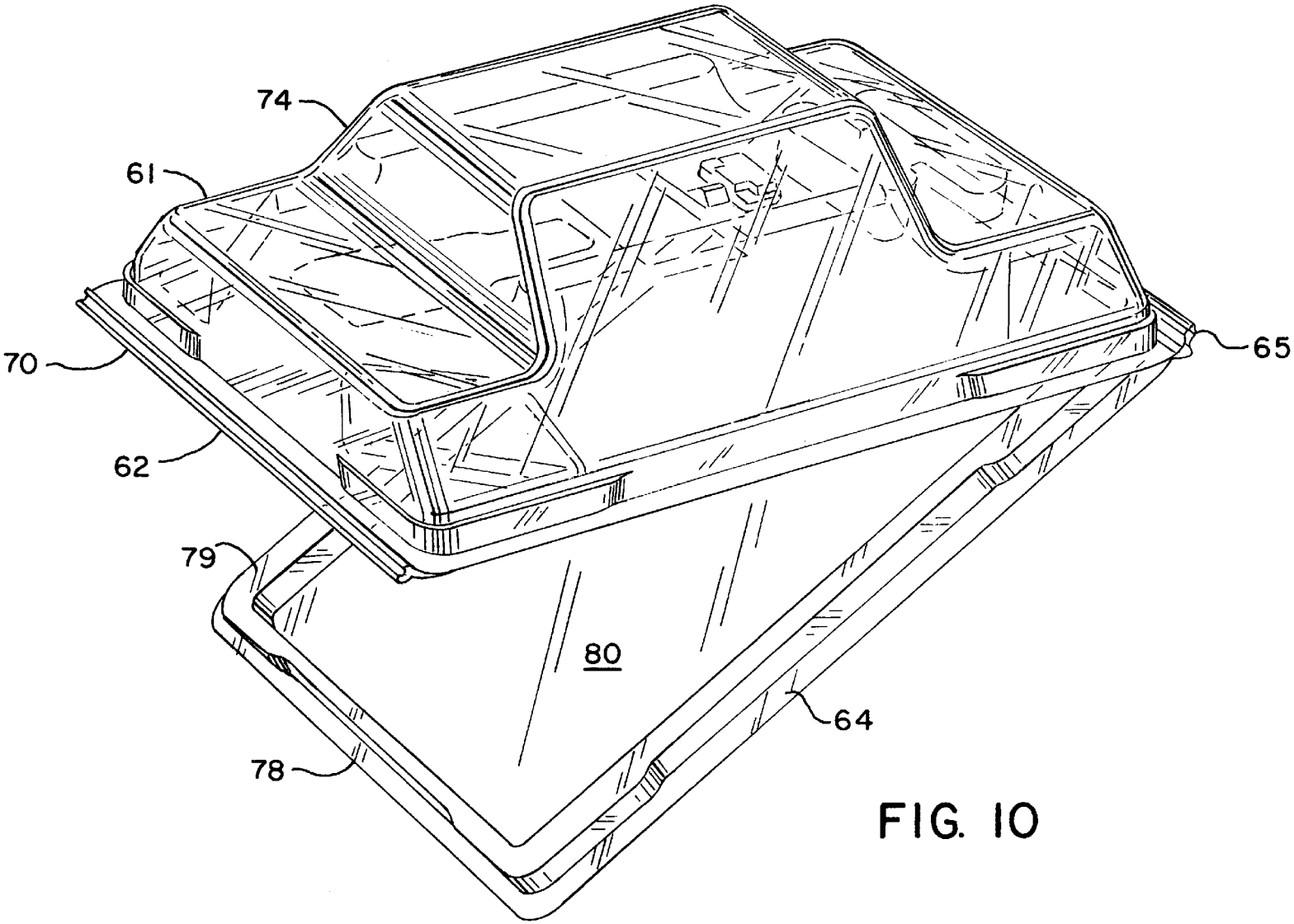
FIG. 10 is a perspective view of the multi-part protector showing the protector in a further folded position.
Figure 11:
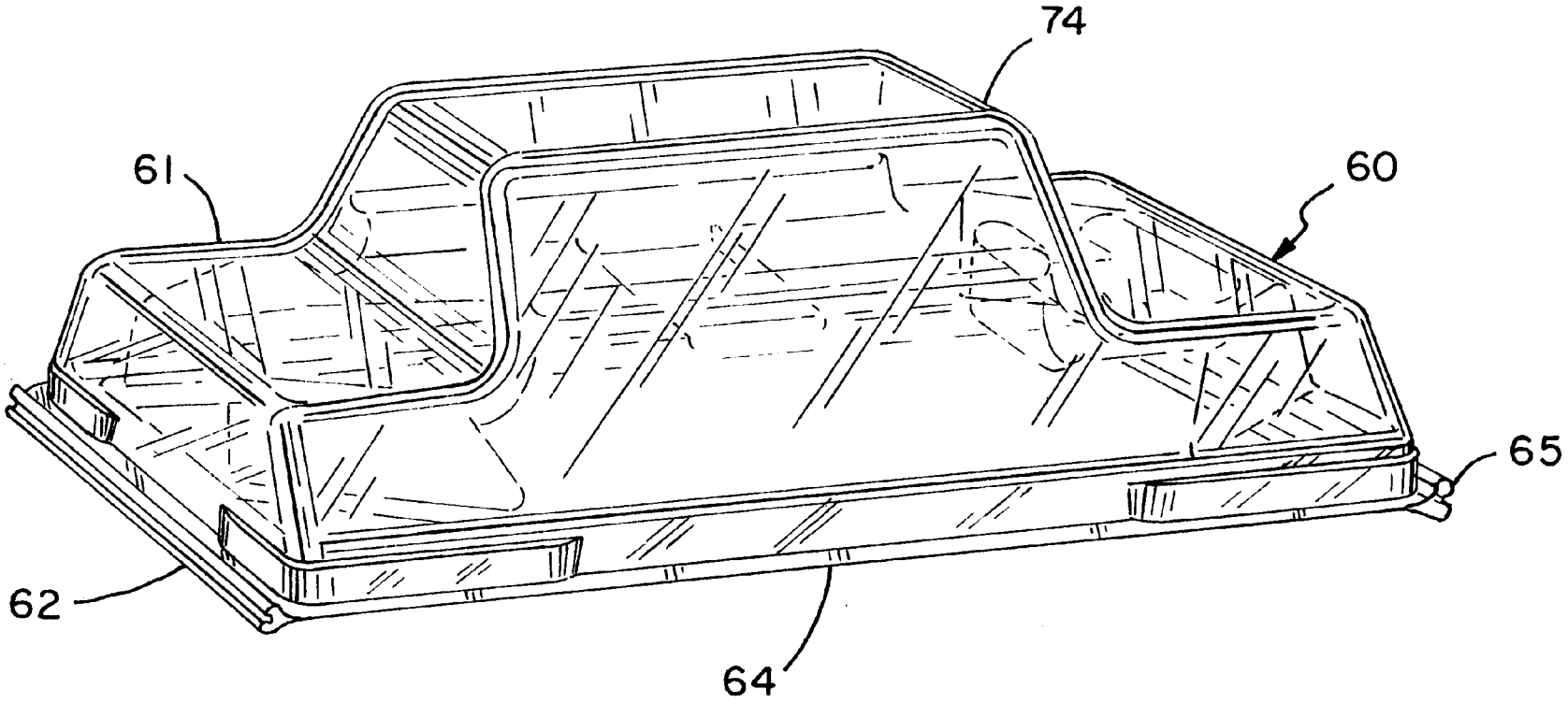
FIG. 11 is a perspective view of the multi-part protector shown in its fully folded and secured position.

Packing of a pager utilizing the multi-part protector 60 takes place in the following manner. First, the pager is mounted onto the mounting panel 23' between the raised lands 28 as described above. Then, the panels 61 and 64 are rotated about the hinge 62 (to an intermediate position as illustrated in FIG. 9), until the dome 74 of the cover panel 61 is over and encloses the pager. Then, as illustrated in FIG. 10, the base panel 64 is rotated about the hinge 65 toward the bottom of the mounting panel 23' and is secured in place when the raised ridge 79 engages the sidewalls 72 of a raised peripheral section of the plateau 71 and is held in place thereby. The completed protector package is shown in FIG. 11. The pager is now fully enclosed and protected by the plastic material of the protector 60 and is suspended away from the top, bottom and side surfaces of the protector so as to be fully isolated from any damaging impact to the surfaces of the protector. The protector 60 may, if desired, be packaged within a cardboard box or other container for shipment to the customer. By utilizing transparent plastic for the material of the protector 60, the completed protector provides an attractive display package for the pocket pagers for retail display purposes while reducing the likelihood of theft of the pager or damage to it. For example, the fully closed protector 60 may be encased in "shrink-wrap" plastic or have the joints at which the base panel 64 engages the peripheral flange 70 of the panel 23' covered with adhesive tape or otherwise sealed together to provide a secure package.

Figure 6:
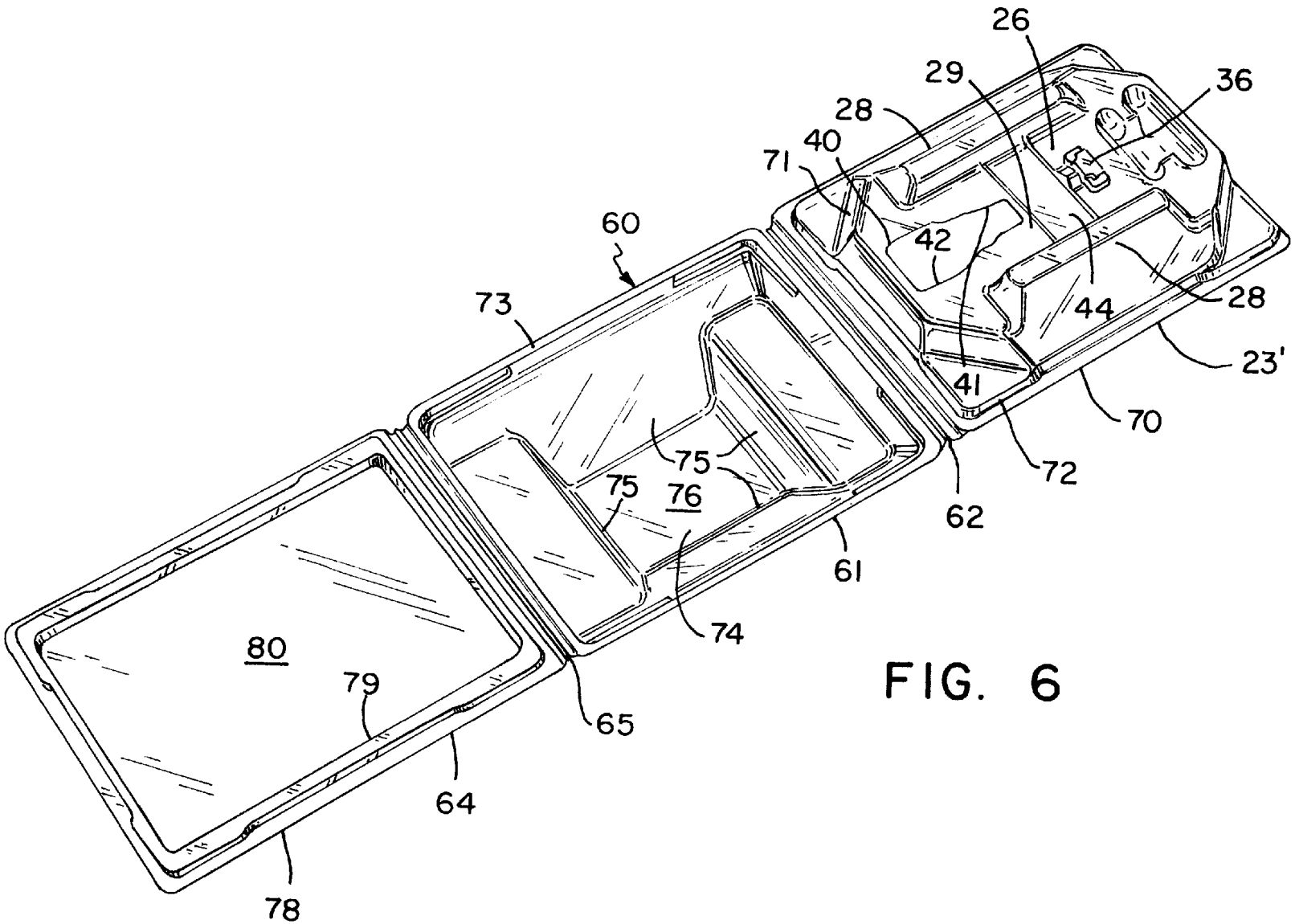
FIG. 6 is a perspective view of a multi-part pager protector in accordance with the invention shown in the fully opened position.
Figure 7:
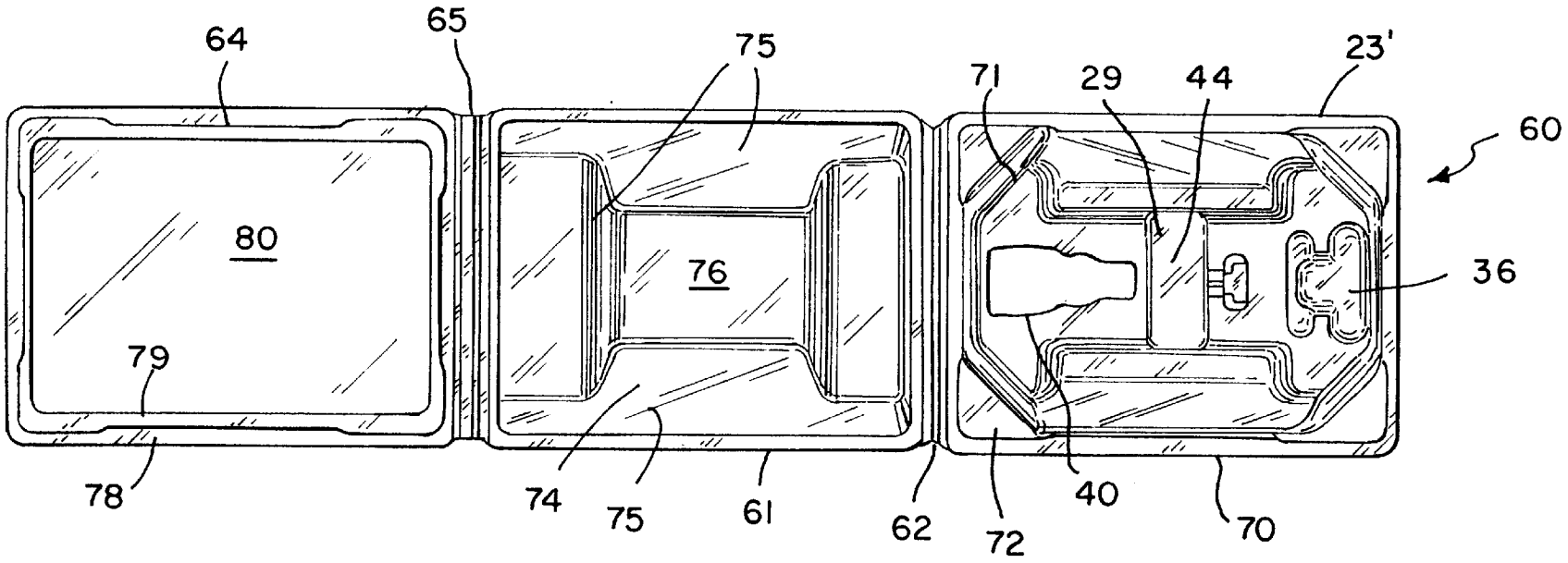
FIG. 7 is a top plan view of the multi-part protector of FIG. 6.
Figure 8:
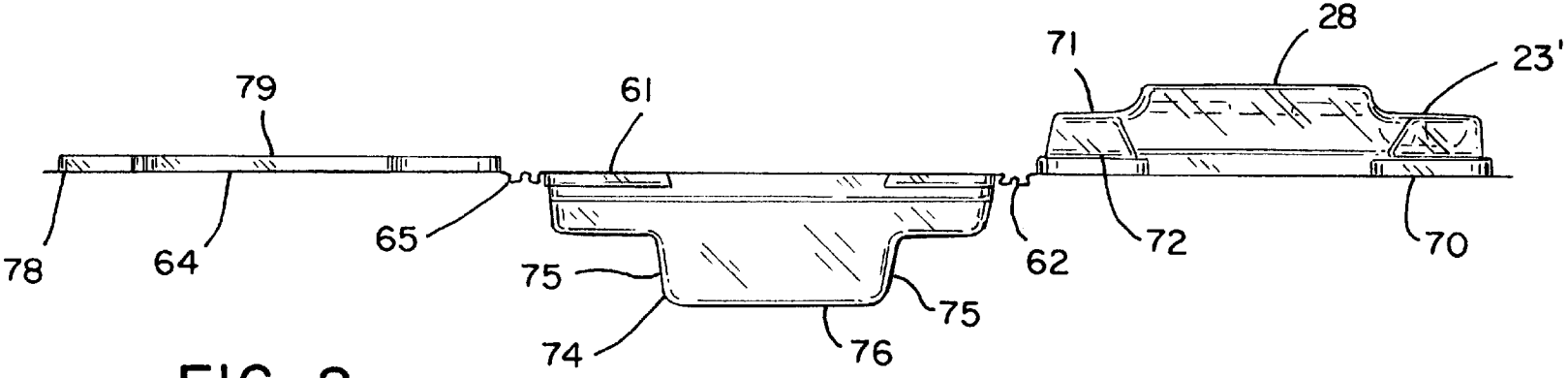
FIG. 8 is a side view of the multi-part protector of FIG. 6.

As is apparent from the perspective view of FIG. 6 and the side view of FIG. 8, when in its fully opened position, the protector 60 can have another protector of identical construction nested into it, allowing multiple protectors to be nested and stacked together in this manner for shipment from the point of production to the point at which the pagers are packaged.

Figure 12:
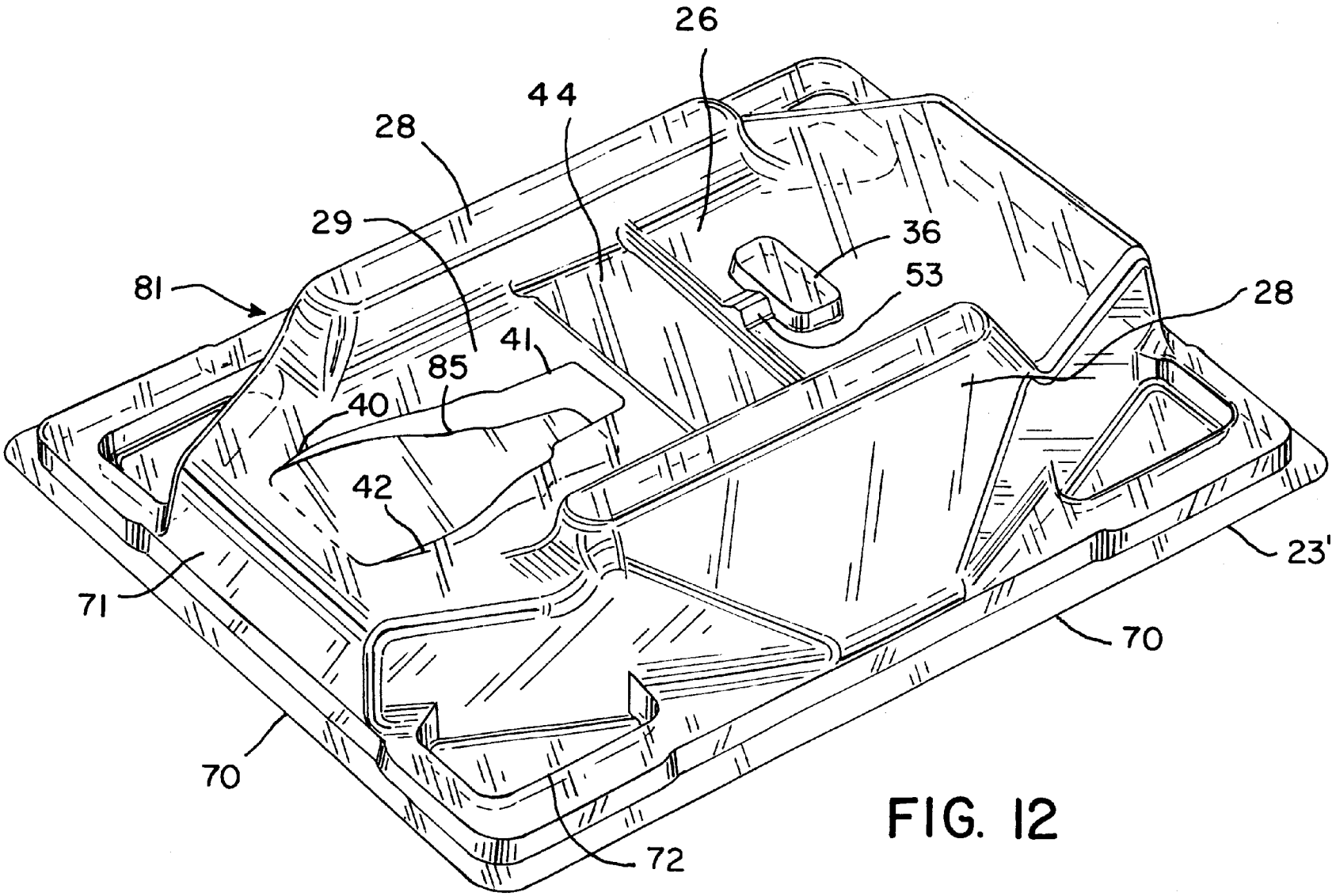
FIG. 12 is a perspective view of a pager protector formed similarly to the mounting panel section of the protector of FIG. 6.
Figure 13:
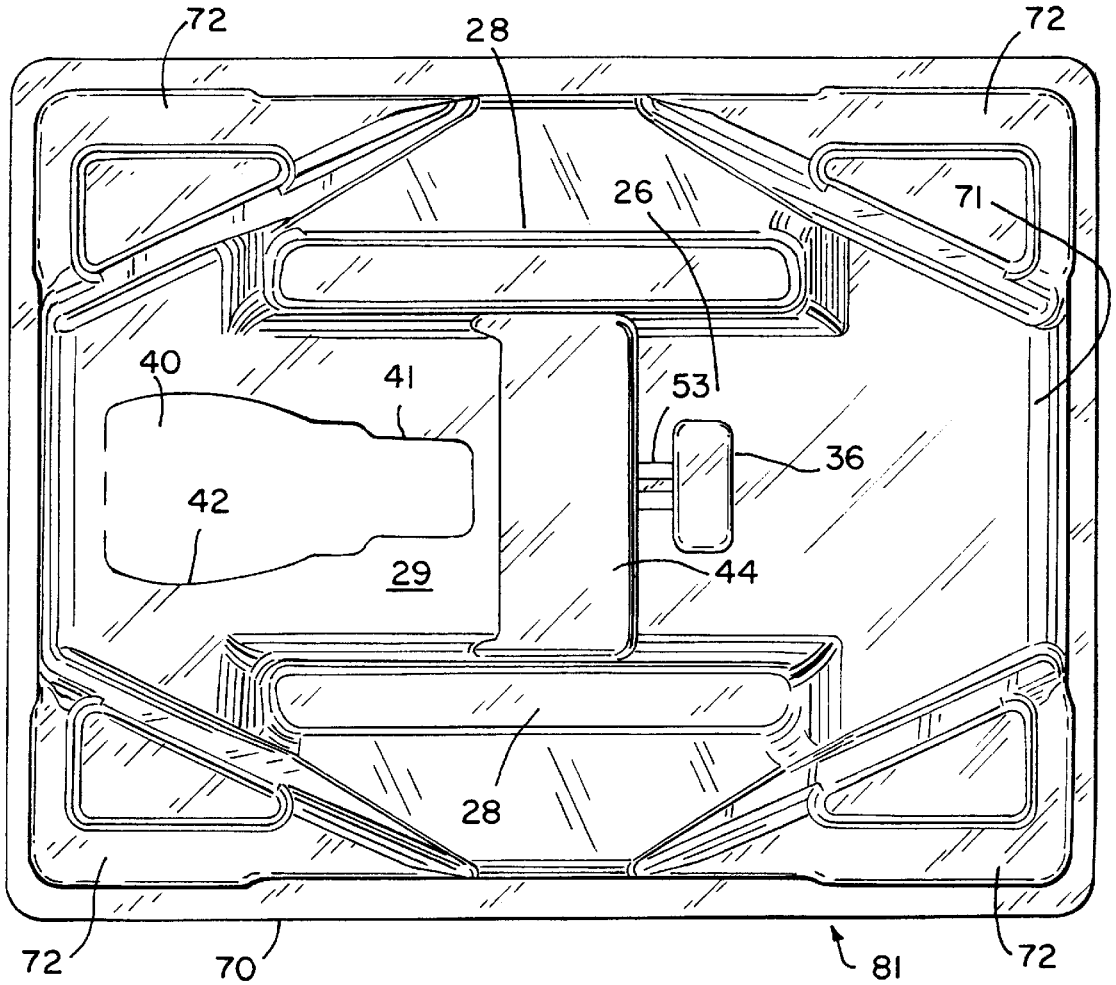
FIG. 13 is a top plan view of the protector of FIG. 12.
Figure 14:
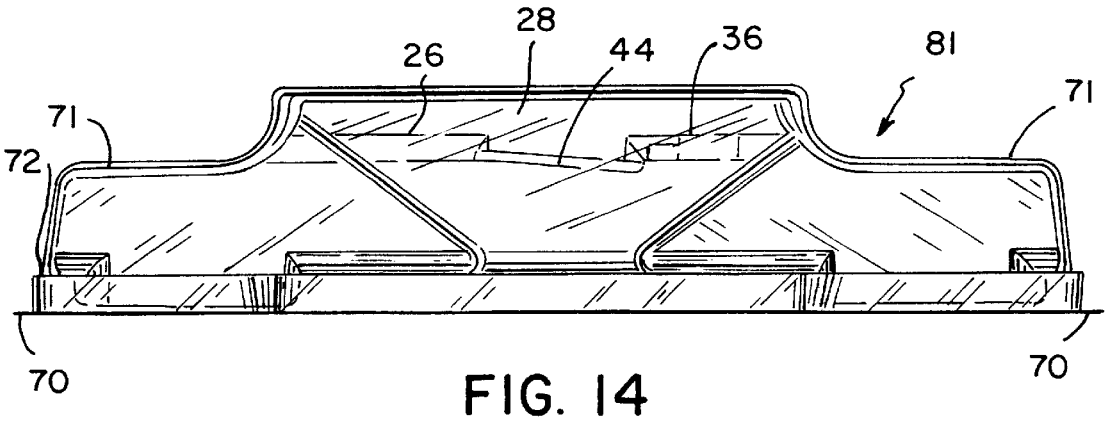
FIG. 14 is a side view of the protector of FIG. 12 taken from the bottom side of FIG. 13.

Although the multi-part protector of FIGS. 6–12 provides a convenient onepiece packaging system for pagers, a mounting panel having the features of the mounting panel of the multi-part protector may be used by itself as a packing insert in a manner similar to the protector of FIGS. 1–5. A one-piece protector of this form is shown at 81 in FIGS. 12–13. It has a mounting panel 23" formed in a manner similar to the mounting panel 23' of FIGS. 6–12 but with the peripheral flange 70 extending entirely around the mounting panel and with no hinged connection to another panel. The construction and features of the single piece protector 81 are as described above for the mounting panel 23'. As illustrated in FIG. 12, the notch 40 may be formed by die cutting the plastic sheet in the central section 29 to define the indentations 41 and 42 in the notch 40. If desired, the bottom edge of the notch furthest away from the indentation 36 does not need to be cut through, so that a flap 85 can be left after the die cutting operation. Because the clip of the pager fits through the notch 40 and its head is drawn toward the indentation 36, the flap 85 does not interfere with the mounting of the pager.

It is understood that the invention is not confined to the particular embodiments set forth herein as illustrative, but embraces all such forms thereof as come within the scope of the following claims.

What is claimed is:

1. A protector for use in packaging a pager of the type having a pager body and a clip with a head, the clip being spring loaded to press the head toward or against the body of the pager to hold the pager in place when it is being worn by an individual, the protector comprising:

(a) a plastic mounting panel having a back face and a front face, surfaces of the back face defining a back plane;

(b) a center section of the panel that generally lies in the back plane;

(c) a notch in the center section of the panel; and (d) an indentation formed in the center section of the panel spaced longitudinally from the notch, the indentation raised above the back plane of the panel, whereby a pager can be mounted on the protector by engaging the head of the pager clip over the panel at a bottom of the notch until the head seats within the indentation and is thereby held in place on the protector.

2. The protector of claim 1 wherein the notch has a first section of a first width and a second outward section of a second, greater width, whereby the notch can accept pager clips of at least two different widths.

3. The protector of claim 1 wherein the indentation has at least a first inner portion of greatest depth and a second outer portion which has a bottom wall of lesser depth than the inner portion and which has a larger periphery than the inner portion, whereby heads of at least two sizes can be best fit within either the inner portion or the outer portion of the indentation.

4. The protector of claim 3 wherein the inner portion of the indentation has sections of at least two different widths to accommodate clip heads of at least two different widths.

5. The protector of claim 1 wherein the panel is vacuum formed and die cut of semi-rigid plastic sheet material.

6. The protector of claim 1 wherein the panel is formed of high impact polystyrene plastic.

7. The protector of claim 1 including a ramp formed in the center section of the panel which is depressed below the back plane and which is positioned between the notch and the indentation to slope away from the back plane in the direction from the notch to the indentation, the ramp terminating in a back edge wall which is adjacent to the indentation, the ramp facilitating the engagement of the pager clip to the insert as the head of the pager clip is pushed onto the ramp until the head of the pager clip passes the edge wall of the ramp.

8. The protector of claim 7 wherein the back edge wall of the ramp adjacent to the indentation is substantially vertical to engage the head of a clip to inhibit the clip from being pulled off of the protector by engagement of the head with the back edge wall of the ramp.

9. The protector of claim 1 further including a pair of raised lands formed in the mounting panel which extend above the back plane thereof, the center section lying between the raised lands and defining with the raised lands a cradle for the pager body.

10. The protector of claim 9 wherein the raised lands are surrounded by portions of the panel which lie substantially in the back plane of the panel.

11. The protector of claim 9 wherein at least outer-most side walls of the raised lands slope inwardly from the back plane to top walls of the raised lands thereby to facilitate compact nesting of multiple protectors for shipment of the protectors.

12. The protector of claim 1 further including a cover panel joined by a hinge to the mounting panel and a base panel joined by a hinge to the cover panel such that the cover panel can be folded over the mounting panel to cover a pager held on the mounting panel and the base panel can be folded under the mounting panel and engaged therewith.

13. The protector of claim 12 wherein the mounting panel, cover panel and base panel are integrally formed from a plastic sheet and the hinges are integrally formed with the panels.

14. The protector of claim 12 wherein the cover panel has a peripheral flange and a dome extending from the flange to encase a pager on the mounting panel when the cover panel is folded onto the mounting panel.

15. The protector of claim 14 wherein the mounting panel has a peripheral flange and a raised plateau extending from the peripheral flange, the surfaces of the back face defining the back plane lying at the top of the raised plateau.

16. Protective packaging for shipment of pagers of the type having a pager body and a clip with a head thereon, the clip being spring loaded to press the head against the body of the pager to hold the pager in place when it is worn by an individual, the packaging comprising:

(a) an outer container having top and bottom walls, and four side walls and end walls between the top and bottom walls;

(b) a protector mounted within the container and sized to substantially conform to the dimensions of the interior of the container, the protector comprising:

(1) a plastic mounting panel having a back face and a front face, surfaces of the back face defining a back plane;

(2) a pair of raised lands formed in the panel which extend above the back plane and which are spaced from each other by a center section of the panel that generally lies in the back plane, the center section and the raised lands defining a cradle for the pager body;

(3) a notch in the center section of the panel lying between the spaced lands; and (4) an indentation formed in the center section of the panel spaced longitudinally from the notch and centered between the raised lands, the indentation raised above the back plane of the panel, whereby a pager can be mounted on the protector by engaging the head of the pager clip over the panel at a bottom of the notch until the head seats within the indentation and is thereby held in place on the protector within the container.

17. The protective packaging of claim 16 wherein the notch has a first section of a first width and a second outward section of a second, greater width, whereby the notch can accept pager clips of at least two different widths.

18. The protective packaging of claim 16 wherein the indentation has at least a first inner portion of greatest depth and a second outer portion which has a bottom wall of lesser depth than the inner portion and which has a larger periphery than the inner portion, whereby heads of at least two sizes can be best fit within either the inner portion or the outer portion of the indentation.

19. The protective packaging of claim 18 wherein the inner portion of the indentation has sections of at least two different widths to accommodate clip heads of at least two different widths.

20. The protective packaging of claim 16 wherein the panel is vacuum formed and die cut of semi-rigid plastic sheet material.

21. The protective packaging of claim 16 wherein the panel is formed of high impact polystyrene plastic.

22. The protective packaging of claim 16 including a ramp formed in the center section of the panel which is depressed below the back plane and which is positioned between the notch and the indentation to slope away from the back plane in the direction from the notch to the indentation, the ramp terminating in a back edge wall which is adjacent to the indentation, the ramp facilitating the engagement of the pager clip to the protector as the head of the pager clip is pushed onto the ramp until the head of the pager clip passes the edge wall of the ramp.

23. The protective packaging of claim 22 wherein the back edge wall of the ramp adjacent to the indentation is substantially vertical to engage the head of a clip to inhibit the clip from being pulled off of the protector by engagement of the head with the back edge wall of the ramp.

24. The protective packaging of claim 16 wherein the raised lands are surrounded by portions of the panel which lie substantially in the back plane of the panel.

25. The protective packaging of claim 16 wherein at least outer-most side walls of the raised lands slope inwardly from the back plane to top walls of the raised lands.

26. A protector for use in packaging a pager of the type having a pager body and a clip with a head, the clip being spring loaded to press the head toward or against the body of the pager to hold the pager in place when it is being worn by an individual, the protector comprising:

(a) a plastic mounting panel having a back face and a front face, surfaces of the back face defining a back plane, and a center section that generally lies in the back plane, a notch in the center section of the mounting panel, and an indentation formed in the center section of the mounting panel spaced longitudinally from the notch, the indentation raised above the back plane of the panel, whereby a pager can be mounted on the protector by engaging the head of the pager clip over the mounting panel at a bottom of the notch until the head seats within the indentation and is thereby held in place on the protector;

(b) a cover panel joined by a hinge to the mounting panel; and (c) a base panel joined by a hinge to the cover panel such that the cover panel can be folded over the mounting panel to cover a pager held on the mounting panel, and the base panel can be folded under the mounting panel and engaged therewith.

27. The protector of claim 26 wherein the mounting panel, cover panel and base panel are integrally formed from a plastic sheet and the hinges are integrally formed with the panels.

28. The protector of claim 26 wherein the cover panel has a peripheral flange and a dome extending from the flange to encase a pager on the mounting panel when the cover panel is folded onto the mounting panel.

29. The protector of claim 28 wherein the mounting panel has a peripheral flange and a raised plateau extending from the peripheral flange, the surfaces of the back face defining the back plane lying at the top of the raised plateau.

30. The protector of claim 26 wherein the notch has a first section of a first width and a second outward section of a second, greater width, whereby the notch can accept pager clips of at least two different widths.

31. The protector of claim 26 wherein the indentation has at least a first inner portion of greatest depth and a second outer portion which has a bottom wall of lesser depth than the inner portion and which has a larger periphery than the inner portion, whereby heads of at least two sizes can be best fit within either the inner portion or the outer portion of the indentation.

32. The protector of claim 31 wherein the inner portion of the indentation has sections of at least two different widths to accommodate clip heads of at least two different widths.

33. The protector of claim 26 wherein the panels are vacuum formed and die cut of semi-rigid plastic sheet material.

34. The protector of claim 26 wherein the panels are formed of high impact polystyrene plastic.

35. The protector of claim 26 including a ramp formed in the center section of the mounting panel which is depressed below the back plane and which is positioned between the notch and the indentation to slope away from the back plane in the direction from the notch to the indentation, the ramp terminating in a back edge wall which is adjacent to the indentation, the ramp facilitating the engagement of the pager clip to the insert as the head of the pager clip is pushed onto the ramp until the head of the pager clip passes the edge wall of the ramp.

36. The protector of claim 35 wherein the back edge wall of the ramp adjacent to the indentation is substantially vertical to engage the head of a clip to inhibit the clip from being pulled off of the protector by engagement of the head with the back edge wall of the ramp.

37. The protector of claim 25 further including a pair of raised lands formed in the mounting panel which extend above the back plane thereof, the center section lying between the raised lands and defining with the raised lands a cradle for the pager body.

38. The protector of claim 37 wherein at least outer-most side walls of the raised lands slope inwardly from the back plane to top walls of the raised lands thereby to facilitate compact nesting of multiple protectors for shipment of the protectors.

* * * * *